US005713552A

United States Patent [19]

Diamant

[11] Patent Number: 5,713,552

[45] Date of Patent: Feb. 3, 1998

[54] EASEL INCLUDING DRAWING SURFACE AND MEDIUM CONTAINER HAVING SEPARATE HANDLE

[75] Inventor: Asher Diamant, Holon, Israel

[73] Assignee: Dicolor Ltd., Ashdod, Israel

[21] Appl. No.: 541,896

[22] Filed: Oct. 10, 1995

[30] Foreign Application Priority Data

Mar. 7, 1995 [IL] Israel ..... 112924

[51] Int. Cl.[6] ..... A47H 1/14

[52] U.S. Cl. ..... 248/460; 211/195

[58] Field of Search ..... 248/460, 461, 248/462, 464, 465, 430; 211/195, 69.1

[56] References Cited

U.S. PATENT DOCUMENTS

| | | | |
|---|---|---|---|
| 2,911,106 | 11/1959 | McCormick | 211/69.1 |
| 4,948,139 | 8/1990 | Heeszel . | |
| 5,035,393 | 7/1991 | Menaged | 248/460 X |
| 5,205,526 | 4/1993 | Deutsch | 248/464 X |
| 5,393,030 | 2/1995 | Tarozzi | 248/60 |
| 5,480,119 | 1/1996 | Fish et al. | 248/460 |

*Primary Examiner*—Ramon O. Ramirez

*Attorney, Agent, or Firm*—Nixon & Vanderhye P.C.

[57] ABSTRACT

An easel including a support assembly, a generally flat drawing surface mounted on the support assembly, and a medium container assembly removably mounted with respect to the flat drawing surface.

9 Claims, 5 Drawing Sheets

EASEL INCLUDING DRAWING SURFACE AND MEDIUM CONTAINER HAVING SEPARATE HANDLE

FIELD OF THE INVENTION

The present invention relates to easels and more particularly to multi-purpose easels for children's use.

BACKGROUND OF THE INVENTION

Various types of easels are known in the art. Foldable and readily assembled easels made of various are also well known.

SUMMARY OF THE INVENTION

The present invention seeks to provide an improved easel which is particularly suitable for use by children.

There is thus provided in accordance with a preferred embodiment of the present invention an easel including a support assembly, a generally flat drawing surface mounted on the support assembly, and a medium container assembly removably mounted with respect to the flat drawing surface. Preferably, the medium container assembly is also pivotably mounted with respect to the flat drawing surface.

There is also provided in accordance with a preferred embodiment of the present invention an easel including a support assembly, a generally flat drawing surface mounted on the support assembly, and a medium container assembly pivotably mounted with respect to the flat drawing surface.

Preferably, the medium container assembly includes a base and a plurality of medium holders pivotably mounted relative to the base.

There is additionally provided in accordance with a preferred embodiment of the present invention an easel including a support assembly, a generally flat drawing surface mounted on the support assembly, and a medium container assembly, the medium container assembly including a base and a plurality of medium holders pivotably mounted relative to the base.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 5:
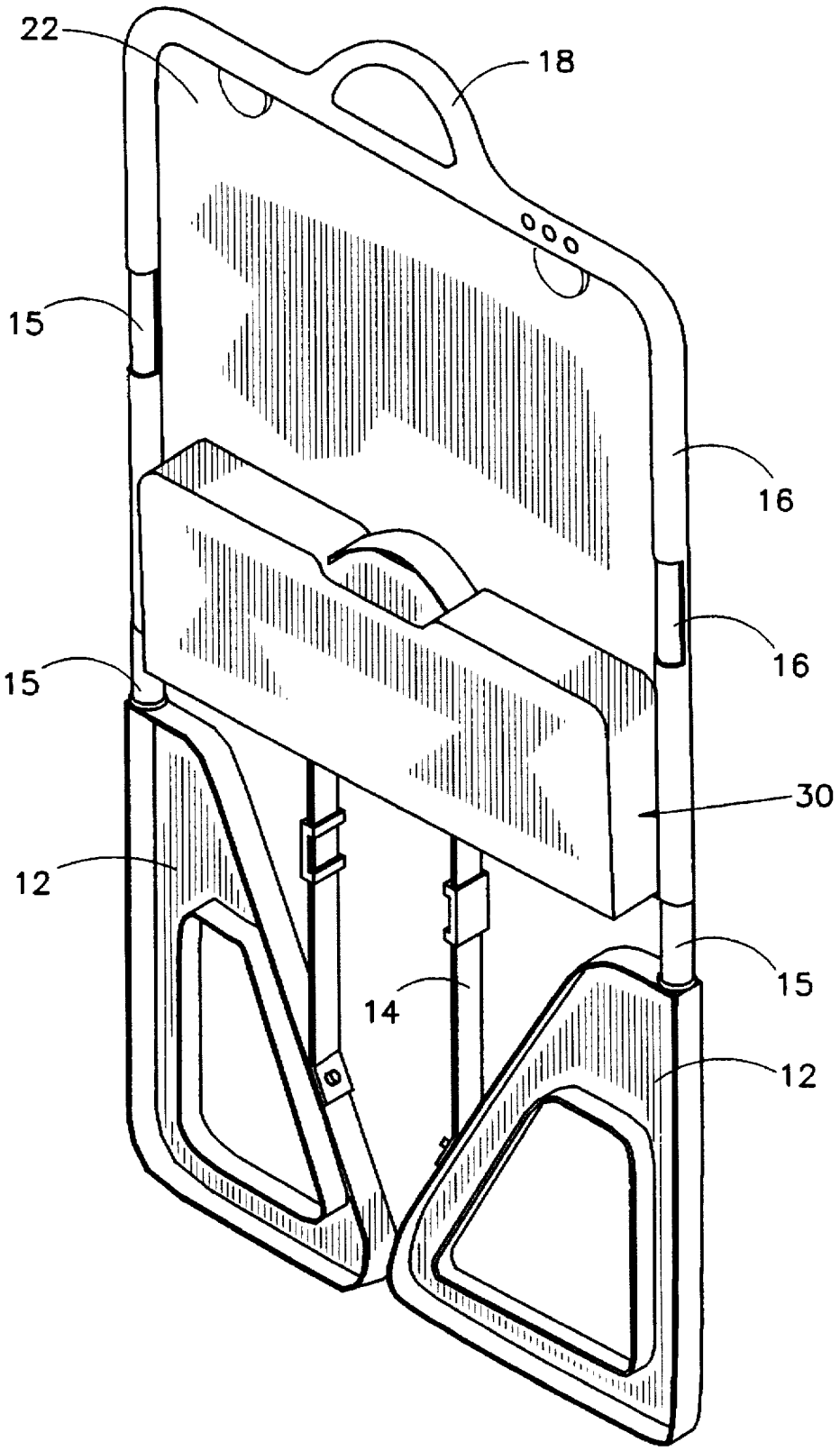
FIG. 5 is a pictorial illustration of the easel of FIGS. 1–3 in a fully folded orientation.

Reference is now made to FIGS. 1–5, which illustrate an easel constructed and operative in accordance with a preferred embodiment of the present invention. The easel comprises a support assembly 10, preferably including a pair of generally triangular foot elements 12 associated with a pair of brace assemblies 14. A peripheral generally tubular frame 16 is rotatably mounted onto foot elements 12, so as to enable the foot elements 12 to be rotated so as to lie in a single plane as seen in FIG. 5.

Frame 16 is preferably integrally formed with a handle 18. Disposed interior of frame 16 is a generally flat drawing surface 22. Drawing surface 22 may be of the erasable board type, such as a blackboard or white board, or may be any other suitable surface, suitable for use in drawing or painting or any other similar activity.

In accordance with a preferred embodiment of the present invention, a medium container assembly 30 is removably and pivotably mounted onto frame 16, for example as by pins 32, mounted onto frame 16, which removably engage suitable sockets 34 formed in container assembly 30. Thus, the medium container assembly is pivotably mounted with respect to the flat drawing surface 22.

In accordance with a preferred embodiment of the present invention, the medium container assembly 30 comprises a base 40, typically in the form of a multi-compartment tray for various paints 42 and other media 44 and a plurality of medium holders 46, 48 and 50, which are pivotably mounted relative to the base 40. Preferably, each of the medium holders may be removably retained in a folded down position in the tray 40, as shown in solid lines in FIG. 4, by means of retaining clips 52. The medium holders 46, 48 and 50 may be sized to hold pens, markers, bottles of paint or any other suitable drawing medium. A handle 54 is preferably mounted on base 40.

Figure 3:
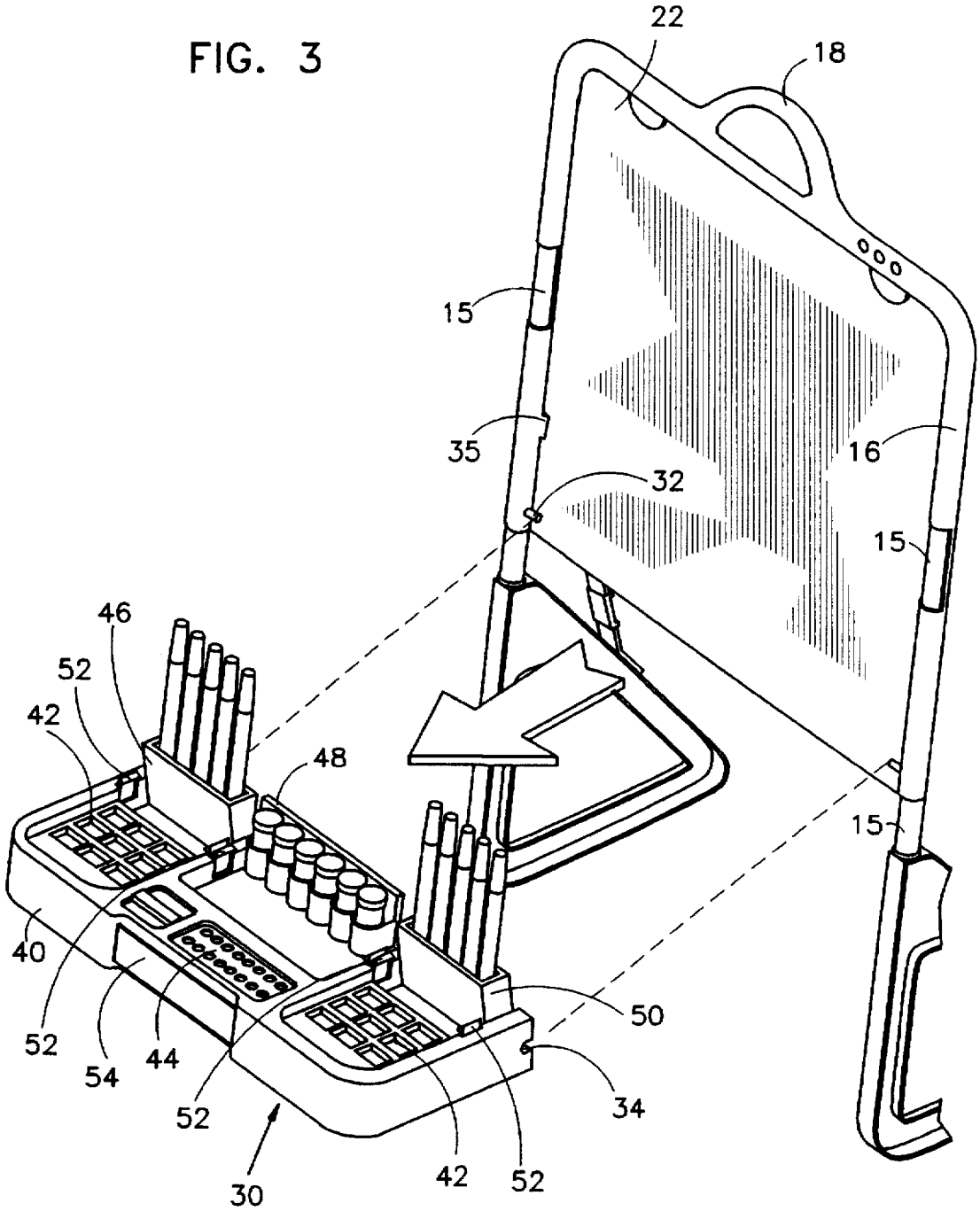
FIG. 3 is a pictorial illustration illustrating removal of the medium container assembly.
Figure 4:
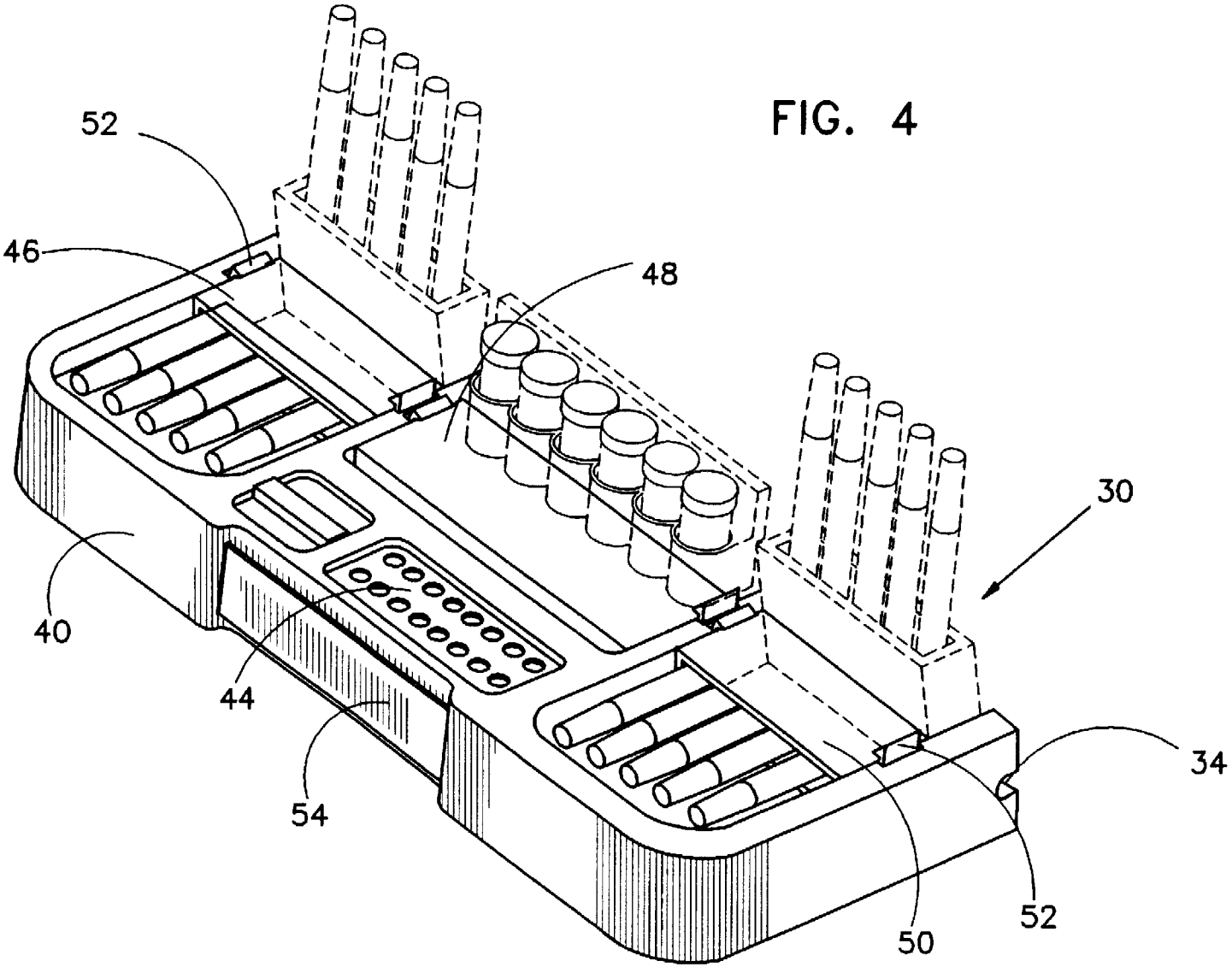
FIG. 4 is a pictorial illustration of the medium container assembly of the easel of FIGS. 1–3 in both a folded and an unfolded (shown in phantom) orientation.

It is a particular feature of the present invention that the entire container assembly 30 may be easily and replaceably removed from the easel, as by simply lifting it out of engagement with pins 32, as seen in FIG. 3. Thus the container assembly 30 may be used separately from the remainder of the easel, if and when desired.

Figure 1:
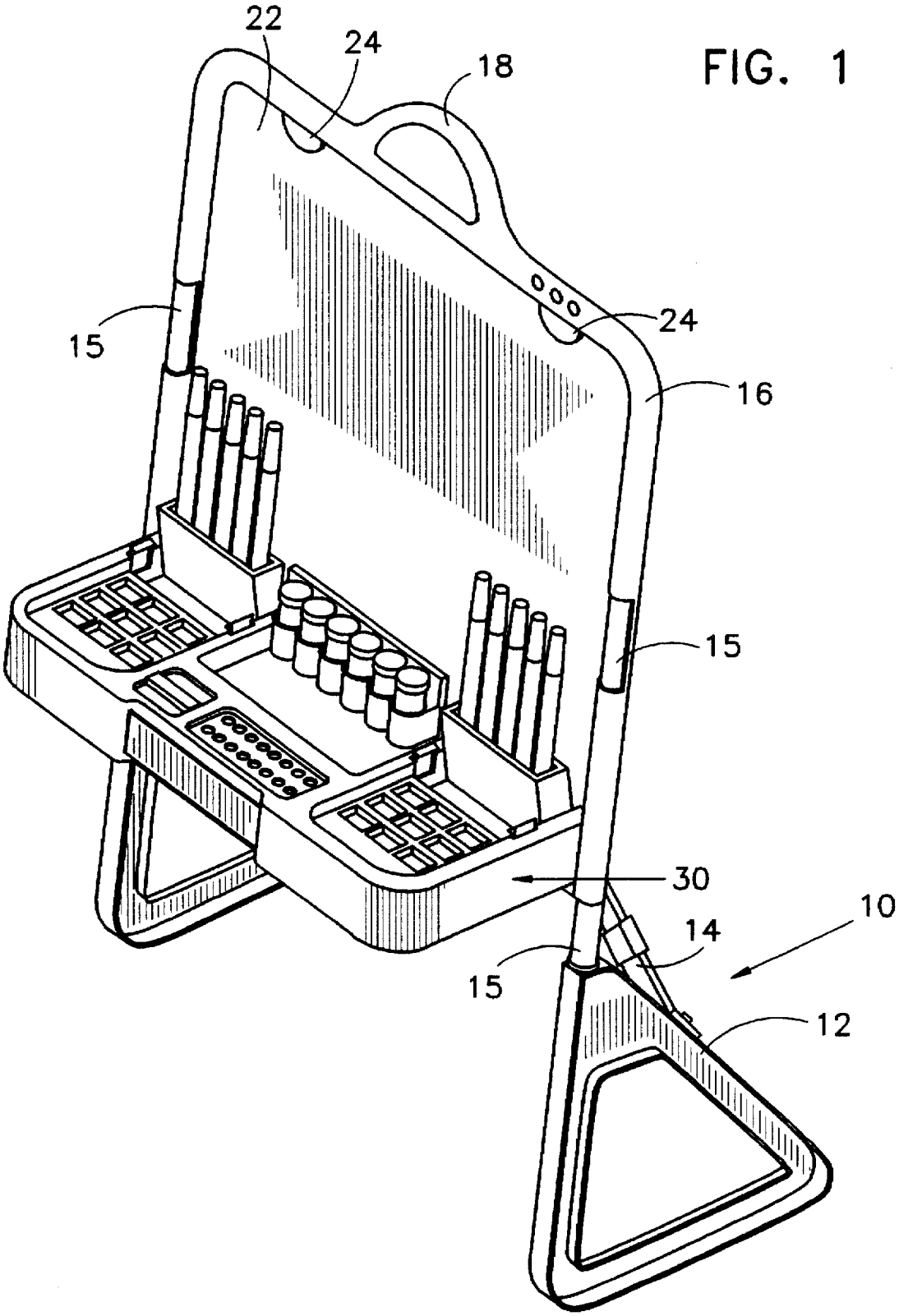
FIG. 1 is a pictorial illustration of an easel constructed and operative in accordance with a preferred embodiment of the/resent invention in a fully open orientation.
Figure 2:
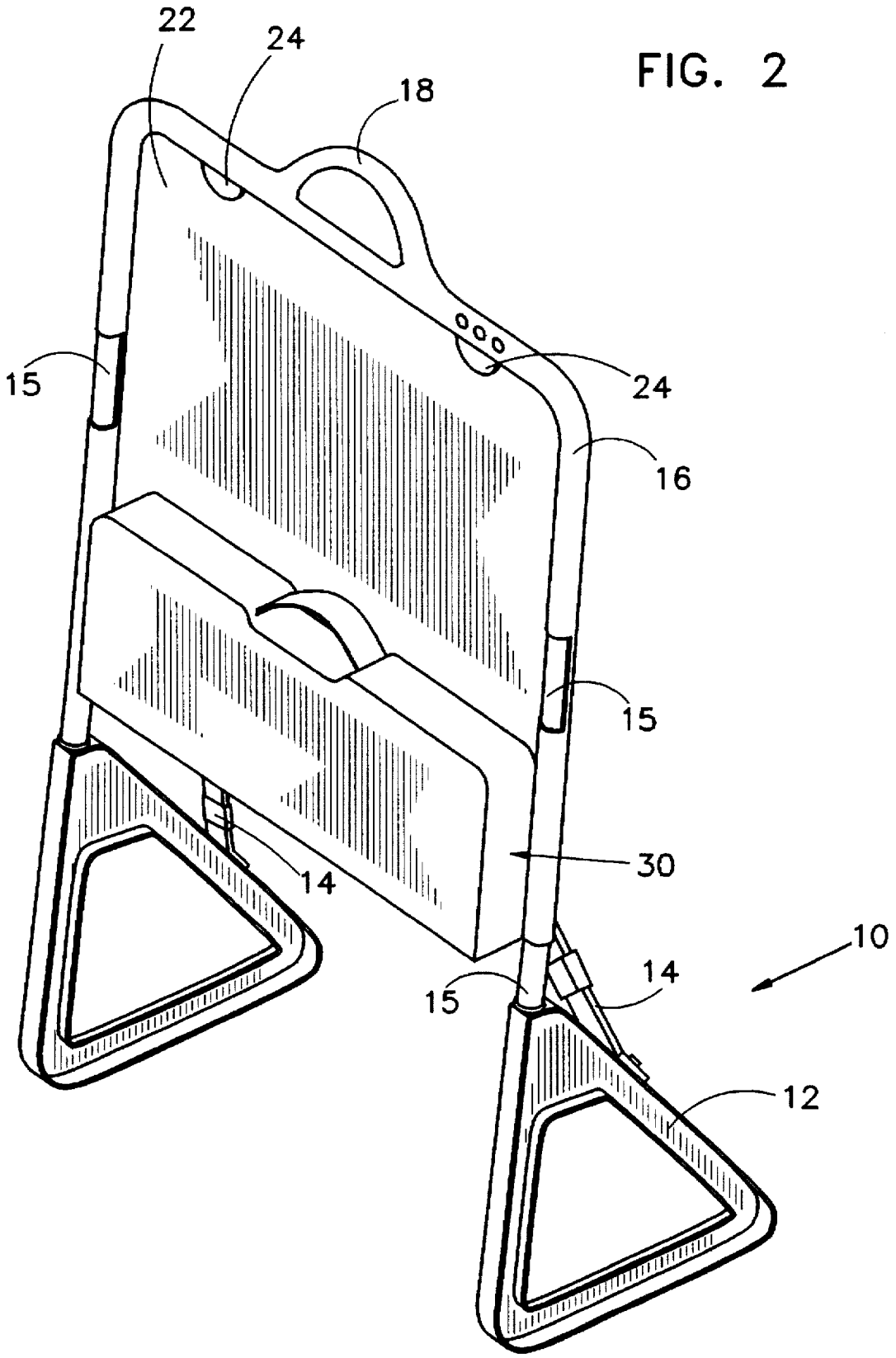
FIG. 2 is a pictorial illustration of the easel of FIG. 1 in a partially folded orientation.

It is also a particular feature of the present invention that the entire easel may be partially folded, when not in use, as shown in FIG. 2, or fully folded for storage or shipment, as shown in FIG. 5.

It will be appreciated by persons skilled in the art that the present invention is not limited by what has been particularly shown and described hereinabove. Rather the scope of the present invention is defined only by the claims which follow:

I claim:

1. An easel comprising:

a supported assembly;

a generally flat drawing surface adapted to be drawn on, mounted on the support assembly; and a medium container assembly having a handle and being removable mounted with respect to the flat drawing surface, whereby the medium cantainer can be readily carried seperately from said easel, wherein the medium container assembly is also pivotably mounted with respect to the flat drawing surface.

2. An easel comprising:

a support assembly;

a generally flat drawing surface mounted on the support assembly; and a medium container assembly pivotably mounted with respect to the drawing surface, said easel also comprising:

a peripheral frame which is attached to and generally surrounds said flat drawing surface and includes a handle portion.

3. An easel comprising:

a support assembly;

a generally flat drawing surface mounted on the support assembly; and a medium container assembly having a handle and being pivotably mounted with respect to the flat drawing surface, whereby the medium container can be readily carried separately from said easel.

4. An easel comprising:

a support assembly;

a generally flat drawing surface mounted on the support assembly; and a medium container assembly pivotably mounted with respect to the flat drawing surface, wherein said medium container assembly comprises a base and a plurality of medium holders pivotably mounted relative to the base.

5. An easel comprising:

a support assembly;

a generally flat drawing surface mounted on the support assembly; and a medium container assembly comprising a base and a plurality of medium holders pivotably mounted relative to the base.

6. An easel according to claim 5 and wherein said support assembly comprises at least one support element which is rotatable relative to said flat drawing surface.

7. An easel according to claim 5 and also comprising a peripheral frame which generally surrounds said flat drawing surface and includes a handle portion.

8. An easel comprising:

a support assembly;

a generally flat drawing surface mounted on the support assembly; and a medium container assembly removable mounted with respect to the flat drawing surface, said easel, wherein said support assembly comprises at least one support element which is rotated relative to said flat drawing surface.

9. An easel comprising:

a support assembly;

a generally flat drawing surface mounted on the support assembly; and a medium container assembly pivotably mounted with respect to the flat drawing surface, wherein said support assembly comprises at least one support element which is rotatable relative to said flat drawing surface.

* * * * *